US007465526B2

(12) United States Patent
Fujino et al.

(10) Patent No.: US 7,465,526 B2
(45) Date of Patent: Dec. 16, 2008

(54) ELECTROSTATIC LATENT IMAGE DEVELOPING TONER

(75) Inventors: Yasumitsu Fujino, Akishima (JP); Noboru Ueda, Hachioji (JP); Seishi Ojima, Hachioji (JP); Mitsutoshi Nakamura, Hino (JP); Hideaki Ueda, Kishiwada (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 82 days.

(21) Appl. No.: 11/038,521

(22) Filed: Jan. 21, 2005

(65) Prior Publication Data

US 2005/0175922 A1 Aug. 11, 2005

(30) Foreign Application Priority Data

Feb. 9, 2004 (JP) ..... 2004-031806

(51) Int. Cl.
*G03G 9/08* (2006.01)

(52) U.S. Cl. ..... 430/108.1; 430/110.2

(58) Field of Classification Search ..... 430/108.1, 430/110.2

See application file for complete search history.

(56) References Cited

U.S. PATENT DOCUMENTS

| | | | | |
|---|---|---|---|---|
| 6,656,653 | B2 | 12/2003 | Mitsuhashi et al. | |
| 7,247,413 | B2 * | 7/2007 | Kido et al. | 430/110.2 |
| 2001/0033982 | A1 | 10/2001 | Ishikawa et al. | |
| 2002/0037468 | A1 * | 3/2002 | Matsushima et al. | 430/110.2 |
| 2002/0042012 | A1 * | 4/2002 | Mitsuhashi et al. | 430/108.23 |
| 2004/0058267 | A1 * | 3/2004 | Ishiyama et al. | 430/110.2 |
| 2004/0146794 | A1 | 7/2004 | Mitsuhashi et al. | |

FOREIGN PATENT DOCUMENTS

| | | |
|---|---|---|
| JP | 2003-255587 | 9/2003 |

* cited by examiner

*Primary Examiner*—Hoa V Le
(74) *Attorney, Agent, or Firm*—Buchanan Ingersoll & Rooney PC

(57) ABSTRACT

An electrostatic latent image developing toner contains toner particles each of which has a shell layer on the surface of a core particle comprising at least a first binder resin having a softening point of less than 100° C., a second binder resin having a softening point of not less than 100° C. and a colorant, being applicable to a low-temperature fixing process, and making it possible to achieve conflict functions, such as a heat-resistant storing property, mechanical strength and charge environmental stability.

16 Claims, No Drawings

ELECTROSTATIC LATENT IMAGE DEVELOPING TONER

BACKGROUND OF THE INVENTION

1. Field of the Invention

The present invention relates to an electrostatic latent image developing toner.

2. Description of the Related Art

Recently, in the field of electrostatic latent image developing toners, along with demands for high image quality in the market, suitable electrophotographic apparatuses and toners usable in such apparatuses have been developed rapidly. For example, with respect to the toners that meet the demands for high image quality, the sharpness in the particle-size distribution is required. When the particle size of a toner is uniformly adjusted with a sharp particle-size distribution, developing behaviors of individual toner particles are uniformly adjusted so that a great improvement in the fine-dot reproducing property is achieved. In this case, however, it is not easy to achieve a sharp toner particle-size distribution. Here, an emulsion polymerization aggregating method has been proposed as a manufacturing method in which the shape of toner particles and the particle-size distribution are made desirably controllable. In this method, a polymer primary fine particle dispersion solution is preliminarily prepared through an emulsion polymerizing process, and a colorant fine-particle dispersion solution and a wax dispersion solution or the like, if necessary, are prepared in a separate manner, and while these solutions are mixed and stirred, with a suitable flocculant such as inorganic metal salt being added thereto so as to aggregate, and this is then heated so that the polymer resin is fused and adhered to obtain toner particles.

There have also been strong demands for energy-saving electrophotographic apparatuses, and since high energy is required for toner fixing processes, there have been strong demands for a low-temperature fixing property in a toner. Because of current demands for high-speed and space-saving copying machines, toners having a superior low-temperature fixing property have been demanded.

The thermal fusing property relating to a toner fixing function greatly depends on the thermal property of a binder resin to be used, and in order to lower the fixing temperature, it is necessary to lower the melting point and melt viscosity of the resin. However, when the melting point and melt viscosity of the binder resin are lowered, new problems, such as degradation in the toner heat-resistant storing property and mechanical strength (stress resistant property) and degradation in the charge environmental stability, are raised.

At present, a toner capable of simultaneously solving such problems with low-temperature fixing property, heat-resistant storing property, mechanical strength and charge environmental stability has not been achieved.

SUMMARY OF THE INVENTION

The present invention is to provide an electrostatic latent image developing toner that is applicable to a low-temperature fixing process and also can ensure conflicting functions, such as a heat-resistant storing property, mechanical strength and charge environmental stability.

The present invention relates to an electrostatic latent image developing toner comprising:

toner particles each of which has a shell layer on the surface of a core particle comprising at least a first binder resin having a softening point of less than 100° C., a second binder resin having a softening point of not less than 100° C. and a colorant.

DETAILED DESCRIPTION OF THE INVENTION

The present invention provides an electrostatic latent image developing toner comprising:

toner particles each of which has a shell layer on the surface of a core particle comprising at least a first binder resin having a softening point of less than 100° C., a second binder resin having a softening point of not less than 100° C. and a colorant.

The present invention makes it possible to achieve a superior low-temperature fixing property, while properly maintaining functions, such as a heat-resistant storing property, mechanical strength and charge environmental stability.

The electrostatic latent image developing toner of the present invention contains core-shell structure toner particles each of which has a shell layer formed on the surface of a core particle.

(Core Particle)

A core particle is constituted by at least specific first binder resin and second binder resin and a colorant. The first binder resin forming the core particles has a softening point (Tm) of less than 100° C., in particular in a range from 60 to 95° C., preferably in a range from 75 to 90° C., and the second binder resin has a softening point Tm of not less than 100° C., in particular in a range from 100 to 150° C., preferably in a range from 105 to 135° C. The core particle of the present invention, which contains the first binder resin and the second binder resin respectively having the above-mentioned softening points, makes it possible to achieve a fixing process at a comparatively low temperature (for example, from not less than 95° C. to less than 106° C.) in comparison with the conventional fixing process and also to effectively ensure mechanical strength. In the case when the first binder resin is not used or the softening point of the first binder resin is not less than 100° C., a fixed image is easily separated at the time of a fixing process at a comparatively low temperature, resulting in degradation in the low-temperature fixing property. In the case when the second binder resin is not used or the softening point of the second binder resin is less than 100° C., a high-temperature offset tends to occur at the time of a fixing process, and the mechanical strength of the toner is lowered to cause toner-particle fragments to adhere to the surface of a photosensitive member, resulting in image noise.

The preferable first and second binder resins are further allowed to the following physical properties:

The first binder resin;

Glass transition temperature (Tg); 20 to 43° C., preferably 25 to 40° C.

The second binder resin;

Tg; 45 to 80° C., preferably from 50 to 70° C.

With respect to the kinds of the first binder resin and the second binder resin, not particularly limited, those binder resins conventionally used in the field of electrostatic-latent-image developing toners may be used. For example, each of the first binder resin and the second binder resin is independently made from one or more kinds of resins selected from the group consisting of a vinyl-based-resin, a polyurethane resin, an epoxy resin and a polyester-based resin. In the case when the first binder resin or the second binder resin is made from a plurality of resins of different types, each of the resins forming the first binder resin or the second binder resin is preferably set in the above-mentioned range, with respect to physical property values such as a softening point. It is preferable that a mixing ratio of the first binder resin to the second binder resin is 50-70:50-30 by weight. When the first binder resin is composed of plural kind of resins, all the resins having Tm as described are regarded as the first binder resin. The same is also applied to the second binder resin composed of plural resins.

With respect to a preferable combination of the first binder resin and the second binder resin, the following combination is proposed:

(First binder resin, second binder resin)=(vinyl-based resin, vinyl-based resin) and (polyester-based resin, vinyl-based resin)

In the present invention, as long as an objective of the present invention is achieved, the core particles may contain a resin other than the first binder resin and the second binder resin.

As long as it contains at least the first binder resin, the second binder resin and a colorant, the core particle may have any structure, and, for example, may have a structure in which at least, the first binder resin fine particles, the second binder resin fine particles and the colorant fine particles are aggregated/fused, or a structure in which at least colorant fine particles are contained in a single resin particle made from the first binder resin and the second binder resin.

In the present specification, the term "aggregation" is used as the concept that at least a plurality of resin particles are simply allowed to adhere to one another. Although constituent particles are made in contact with one another through "aggregation", bonds, which are made through fusion between the resin particles, are not formed; thus, so-called hetero-aggregated particles (group) are formed. Here, the particle group, formed through such "aggregation", is referred to as "aggregated particles".

The term "fusion-adhesion" is used as the concept that a bond is formed through melting between resin fine particles at least one portion on the interface of the respective constituent particles in the aggregated particles to provide one particle that forms a unit in use and handling. The group of particles that are subjected to such "fusion-adhesion" are referred to as "fused particles".

Here, the term "aggregating/fusion-adhering" indicates the fact that aggregating and fusion-adhering processes are carried out simultaneously or step by step, or the action that allows the aggregating and fusion-adhering processes to take plate simultaneously or step by step.

The core particle having the structure in which at least the first binder resin fine particles, the second binder resin fine particles and the colorant fine particles are aggregated and fusion-adhered to one another is formed in the following processes in which: first, a resin fine particle dispersion solution of the first binder resin and the second binder resin is prepared, and the resulting dispersion system of the first binder resin fine particle dispersion solution and the second binder resin fine particle dispersion solution are mixed with at least a colorant fine particle dispersion solution so that these fine particles are aggregated/fusion-adhered to one another.

With respect to the preparation method for the resin fine particle dispersion solution of the first binder resin and the second binder resin, not particularly limited as long as resin fine particles having a volume-average particle size of about 20 to 250 nm, preferably about 40 to 200 nm, are formed, and for example, a wet method, such as an emulsion polymerization method, a suspension polymerization method and an emulsion dispersion method, may be used.

For example, upon preparing a fine particle dispersion solution of a radical polymerization-type resin such as a vinyl-based resin, normally, the emulsion polymerization method is adopted. More specifically, a polymer composition containing a polymerizable monomer is dispersed in an aqueous medium containing a polymerization initiator and emulsion-polymerized to such a level that predetermined physical property values such as softening point are achieved. At this time, by preliminarily dispersing other toner components such as a wax, a charge-controlling agent and magnetic powder in the aqueous medium, a seed emulsion polymerizing process may be carried out, or by preliminarily dissolving and dispersing the other toner components in the polymer composition, an emulsion polymerizing process may be carried out. Thus, the other toner components are contained in the resin fine particles.

With respect to the polymerizable monomer, at least one kind of a monomer, selected from radical polymerizable monomers, in particular, containing an acidic group, which contains a radical polymerizable monomer as an essential constituent component, is preferably used. A crosslinking agent may be used, if necessary. Examples of such a radical polymerizable monomer include an aromatic vinyl monomer and a (meth)acrylate-based monomer.

With respect to the vinyl aromatic monomers, examples thereof include: styrene-based monomers and derivatives thereof, such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

With respect to the (meth)acrylic acid ester-based monomers, examples thereof include: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxy acrylate, propyl γ-amino acrylate, stearyl methacrylate, dimethylaminoethyl methacrylate and diethylaminoethyl methacrylate.

With respect to the radical polymerizable monomer having an acidic group, examples thereof include carboxylic-acid-group-containing monomers such as acrylic acid, methacrylic acid, fumaric acid, maleic acid, itaconic acid, cinnamic acid, monobutyl maleate and monooctyl maleate; and sulfonic-acid-group containing monomers, such as styrene sulfonate, allyl sulfosuccinate and octyl allyl sulfosuccinate. All or one portion of the radical polymerizable monomer having an acidic group may have a structure of alkali metal salt such as sodium and potassium or alkali-earth metal salt such as calcium. The rate of the radical polymerizable monomer having an acidic group, which accounts for the polymerizable monomer (monomer mixture) to be used, is preferably set in a range from 0.1 to 20% by mass, more preferably from 0.1 to 15% by mass.

In order to control the degree of polymerization of resins and adjust physical properties such as a softening point and a molecular weight thereof, a chain transfer agent may be added to the polymer composition. With respect to the chain transfer agent, not particularly limited, a generally-used chain transfer agent in the radical polymerization reaction may be adopted. Specific examples thereof include: mercaptans, such as octyl mercaptan, dodecyl mercaptan and tert-dodecyl mercaptan, and styrene dimers.

With respect to the radical polymerization initiator, any of those conventional initiators may be properly used as long as it is water-soluble. Examples thereof include persulfates, such as potassium persulfate and ammonium persulfate, azo-based compounds such as 4,4'-azobis 4-cyano valerate and salts thereof, and 2,2'-azobis(2-amidinopropane) and salts thereof, and peroxide compounds. The above-mentioned radical polymerization initiator may be combined with a reducing agent, if necessary, and prepared as a redox-based initiator. By using the redox-based initiator, the polymerization activity is enhanced so that the polymerization temperature is lowered and the polymerization time can be shortened.

A surfactant may be added to the aqueous medium. With respect to the surfactant, not particularly limited, the following ionic and nonionic surfactants are preferably used.

With respect to ionic surfactants, examples thereof include sulfonates (such as sodium dodecylbenzene sulfonate, sodium arylalkylpolyether sulfonate, sodium 3,3-disulfone-diphenyl urea-4,4-diazo-bis-amino-8-naphthol-6-sulfonate, ortho-carboxybenzene-azo-dimethyl aniline and sodium 2,2,5,5-tetramethyl-triphenyl methane-4,4-diazo-bis-6-naphthol-6-sulfonate), sulfates (such as sodium dodecyl sulfate, sodium tetradecyl sulfate, sodium pentadecyl sulfate and sodium octyl sulfate), and fatty acid salts (such as sodium oleate, sodium laurate, sodium caprinate, sodium caprylate, sodium capronate, potassium stearate and calcium oleate).

With respect to nonionic surfactants, specific examples thereof include polyethylene oxide, polypropylene oxide, a combination of polypropylene oxide and polyethylene oxide, an ester of polyethylene glycol and higher fatty acid, alkyl phenol polyethylene oxide, an ester of higher fatty acid and polyethylene glycol, an ester of higher fatty acid and polypropylene oxide and a sorbitan ester; however, these may be used in combination with the aforementioned ionic surfactant, if necessary.

In the present invention, the nonionic surfactant, which is used as an emulsifier at the time of emulsion polymerization, is also used so as to stabilize dispersion of respective fine particles in aggregation processes, which will be described later, and also adjust the aggregating force of the dispersed fine particles. In other words, the nonionic surfactant becomes extremely poor in its particle dispersion stabilizing property when its clouding point is exceeded; therefore, upon preparation of the fine-particle dispersion solution, an appropriate amount thereof is made to coexist with an ionic surfactant or an appropriate amount thereof is preliminarily added to the dispersion system so that based upon control on the aggregating temperature, the aggregating force between fine particles can be adjusted, thereby making it possible to provide evenness and proper efficiency in the aggregation of the particles.

For example, upon preparation of a fine particle dispersion solution of a condensation-polymerizing type resin such as a polyester-based resin, normally, an emulsion dispersion method is adopted. More specifically, a resin solution, prepared by dissolving a resin having predetermined physical property values such as a softening point, for example, a polyester-based resin, in a non-water-soluble organic solvent, is dispersed in an aqueous medium to form an O/W type emulsion so that the non-water-soluble organic solvent is removed by applying heat. At this time, other toner components, such as a wax, a charge-controlling agent and magnetic powder, may be preliminarily dissolved and dispersed in the resin solution so as to be contained in the resin fine particles.

With respect to the resin to be used in the emulsion dispersion method, it is not particularly limited as long as it is soluble to the non-water-soluble organic solvent, and the following description will discuss a case in which a polyester-based resin is used.

With respect to the polyester-based resin, although not particularly limited as long as it has the predetermined physical properties such as a softening point, in particular, those containing an etherified diphenol as an alcohol component and an aromatic dicarboxylic acid as an acid component are preferably used.

With respect to the etherified diphenols, examples thereof include: polyoxypropylene(2,2)-2,2-bis(4-hydroxyphenyl) propane, polyoxypropylene(3,3)-2,2-bis(4-hydroxyphenyl) propane, polyoxypropylene(2,0)-2,2-bis(4-hydroxyphenyl) propane, polyoxypropylene(6)-2,2-bis(4-hydroxyphenyl) propane, polyoxyethylene(2)-2,2-bis(4-hydroxyphenyl) propane, and polyoxyethylene(2,2)-2,2-bis(4-hydroxyphenyl)propane.

With respect to the alcohol components, in addition to etherified diphenols, diols, such as ethylene glycol, diethylene glycol, triethylene glycol, 1,2-propylene glycol, 1,3-propylene glycol, 1,4-butanediol and neopentyl glycol; and sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene may be used.

With respect to the aromatic dicarboxylic acids, for example, aromatic dicarboxylic acids, such as terephthalic acid and isophthalic acid, and acid anhydrides thereof or lower alkyl esters thereof may be used.

With respect to the acid components, aliphatic dicarboxylic acids, such as fumaric acid, maleic acid, succinic acid and alkyl or alkenyl succinic acids having 4 to 18 carbon atoms, and acid anhydrides thereof or lower alkyl esters thereof may be used.

With respect to the acid component, polycarboxylic acids, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, anhydrides or low alkyl esters of these acids, may be used in a small amount within a range without impairing properties such as light-transmitting property, in order to adjust the acid value of the polyester resin and improve the strength of the resin.

With respect to the polyester-based resin, a urethane-modified polyester resin, an acryl-modified polyester resin and the like, obtained by allowing a polyester resin to react with isocyanate, may be used.

With respect to the non-water-soluble organic solvent that is used for dissolving or dispersing a toner component (a resin and a wax, if necessary, and other toner components such as a charge-controlling agent and magnetic powder), examples thereof include: toluene, benzene, xylene, methylene chloride, chloroform, carbon tetrachloride, dimethyl ether, diethyl ether, methyl acetate, ethyl acetate, butyl acetate, methyl propionate, ethyl propionate, butyl propionate, dimethyl oxalate, diethyl oxalate, dimethyl succinate, diethyl succinate, diethyleneglycol dimethyl ether, diethyleneglycol diethyl ether, diethyleneglycol dibutyl ether, ethyleneglycol monoacetate, diethyleneglycol monoacetate, ethanol, propanol, butanol, diacetone alcohol, acetone, methylethyl ketone, methylisobutyl ketone, N,N-dimethylformamide, 2-methoxyethanol, 2-ethoxyethanol, diethyleneglycol monomethyl ether, diethyleneglycol monoethyl ether, diethyleneglycol monobutyl ether, dipropyleneglycol monomethyl ether, dipropyleneglycol monoethyl ether and 2-methoxyethyl acetate, 2-ethoxyethyl acetate, and one of these may be used alone, or two or more kinds of these may be used in combination.

In order to dissolve or disperse the toner component in the non-water-soluble organic solvent, for example, a device, such as a ball mill, a sand mill, a homomixer and an ultrasonic homogenizer, may be used.

Upon forming an O/W type emulsion by dispersing the resin solution in an aqueous medium, may be employed a method in which the same device as a device that is used for dissolving or dispersing the toner component in the non-water-soluble organic solvent may be used so as to sufficiently stir a mixed system between the resin solution and the aqueous medium. Here, the O/W type emulsion refers to a suspension in which an oil liquid is dispersed in the aqueous medium as droplets.

It is preferable to add an appropriate dispersion stabilizer to the aqueous medium. Examples thereof include: polyvinyl alcohol, gelatin, Arabic rubber, methyl cellulose, ethyl cellulose, methylhydroxypropyl cellulose, sodium salt of carboxymethyl cellulose, sodium dodecylbenzene sulfate, sodium dodecylbenzene sulfonate, sodium octylsulfate, sodium laurylate, calcium phosphate, magnesium phosphate, aluminum phosphate, calcium carbonate, magnesium carbonate, barium sulfate and bentonite, and each of these dispersion stabilizers may be used in a range from 0.05 to 3% by weight.

The removal of the non-water-soluble organic solvent from the O/W type emulsion is achieved by heating the O/W type emulsion while being stirred, thereby making it possible to provide a resin fine particle dispersion solution.

After the first binder resin fine particle dispersion solution and the second binder resin fine particle dispersion solution have been prepared as described above, these dispersion solutions and at least a colorant fine particle dispersion solution are mixed, and those fine particles are aggregated/fused to form core particles. In this case, other toner components, such as a wax, a charge-controlling agent and magnetic powder, may be aggregated/fused together with the resin fine particles and colorant fine particles so that the other toner components are contained in the core particles.

Upon aggregating/fusing processes, at least a flocculant may be added to the mixture dispersion system of the first binder resin fine particle dispersion solution, the second binder resin fine particle dispersion solution and the colorant fine particle dispersion solution in an amount exceeding a critical flocculation concentration so that the respective fine particles may be aggregated through salting-out and further heated to be fused with one another. The aggregating process and the fusing process may be carried out simultaneously. Here, in these processes, the fusing process is not necessarily carried out. This is because the fusing process of the core particles is achieved by a heating process in a shell-layer forming process, which will be described later.

With respect to the flocculant, for example, alkali metal salt and alkali earth metal salt may be used. Examples of alkali metals include monovalent metals such as lithium, potassium and sodium. Examples of alkali earth metals include divalent metals such as magnesium, calcium, strontium and barium, and divalent or more metals such as aluminum may also be used. Preferable examples thereof include potassium, sodium, magnesium, calcium and barium. With respect to the salt to be formed with these metals, examples thereof include a chlorine salt, a bromine salt, an iodine salt, carbonate and sulfate.

The colorant fine particle dispersion solution is prepared by dispersing a colorant in an aqueous medium. The dispersing process of the colorant is carried out in a state in which the surfactant concentration is set to not less than a critical micelle concentration (CMC). With respect to the surfactant, anionic surfactants and nonionic surfactants may be used, and one of these may be used alone, or two or more of these may be used in combination with appropriate compositions. With respect to the dispersing device to be used for the dispersing process of the colorant, although not particularly limited, preferably an ultrasonic dispersing device, a pressure dispersing device such as a mechanical homogenizer and a pressure-type homogenizer, and a medium-type dispersing device such as a sand grinder and a diamond fine mill may be used. With respect to the surfactant to be used, the same surfactants as described earlier may be used.

With respect to the colorant, known pigments that have been conventionally used as colorants for use in a full-color toner may be used. Examples thereof include: carbon black, aniline blue, Chalcooil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1 and C.I. Pigment Blue 15:3, etc.

The amount of the colorant used is preferably set to a content in a range from 2 to 20 parts by weight, preferably in a range from 4 to 15 parts by weight, with respect to 100 parts by weight of the binder resin in the toner particles. In the present specification, the term, "100 parts by weight of the binder resin", refers to a value corresponding to the total amount of the first binder resin and the second binder resin forming core particles and a shell-layer-forming binder resin, which will be described later.

(Shell Layer)

In the present invention, a shell layer is formed on the surface of each of core particles; therefore, by imparting different functions to the core particle and the shell layer so as to allow them to exert separate functions, it becomes possible to effectively ensure a heat-resistant storing property, proper mechanical strength and charge environmental stability, together with a low-temperature fixing property. Without the shell layer, although a low-temperature fixing property is properly maintained, the heat-resistant storing property, mechanical strength and charge environmental stability would be lowered.

The shell layer can be made from a shell-layer-forming binder resin, and the kind of the resin is not particularly limited. For example, in the same manner as the first binder resin and the second binder resin forming the core particles, the material resin may be one or more kinds of resins selected from the group consisting of vinyl-based resins, polyurethane resins, epoxy resins and polyester-based resins.

The shell layer may have a single layer structure, or may have a multiple layer structure constituted by two or more layers.

In the case when the shell layer has a single layer structure, from the viewpoint of improving the toner heat-resistant storing property, mechanical strength and charge environmental stability, the constituent resin of the layer preferably has Tg of not less than 55° C., preferably in a range from 55 to 75° C., more preferably in a range from 60 to 70° C. From the same viewpoint, it preferably has Tm in a range from 100 to 160° C., more preferably in a range from 110 to 140° C.

In the case when the shell layer has a multilayer structure, the physical property values such as Tg of the constituent resin of the outermost layer are preferably set in the above-mentioned ranges. In this case, although not particularly limited, the physical property values such as Tg of the shell layer constituent resin except for the outermost layer are preferably set in the above-mentioned ranges in the same manner as the outermost layer.

The shell layer may be formed through the following processes in which: first, a dispersion solution of predetermined shell-layer forming binder resin fine particles (hereinafter, also referred to as shell particles) is prepared; the resulting dispersion solution is mixed in a core particle dispersion solution; and the shell particles are adhered/fused onto the surface of each of core particles. More specifically, a predetermined amount of a shell particle dispersion solution is added and mixed in the core particle dispersion solution; thus, the shell particles are adhered to the surface of each of the core particles to grow the core particle so that the resulting particle is heated and fused to form a shell layer. Upon forming a shell layer having a multiple layer structure, the process in which shell particles are mixed, and adhered/fused is preferably repeated two or more times. Upon forming a shell layer having a multiple layer structure, shell particles, which form shell layers other than the outermost layer, that is, shell particles forming a first shell layer to be preliminarily formed, for example, when the shell layer has two-layer structure, are allowed to contain other toner components such as a wax, a charge-controlling agent and magnetic powder so that other toner components may be contained in the shell layer. In particular, when wax is added to the shell particles forming the shell outermost layer, filming and the like tend to occur due to wax isolation, resulting in problems.

In the present specification, "adhesion/fusion" refers to a case in which adhesion and fusion take place simultaneously or step by step, or a process in which adhesion and fusion are made to occur simultaneously or step by step.

With respect to the preparation method for the shell particle dispersion solution, except that the shell-layer forming binder resin fine particles having the above-mentioned physical properties such as Tg are preferably obtained, the same preparation method as that of the first and second binder resin fine particle dispersion solution can be used, and the method is appropriately selected depending on the kinds of resins. In particular, the volume-average particle size of the shell particles is set in the same range as the first and second binder resin fine particles. In the case when other toner components such as a wax are contained in the shell particles, the following methods may be adopted: a method in which, as described earlier, with other toner components being preliminarily dispersed in an aqueous medium, a seed emulsion polymerization is carried out; a method in which, with other toner components being preliminarily dissolved and dispersed in a polymerizable composition, an emulsion polymerization is carried out; and a method in which, with other toner components being preliminarily dissolved and dispersed in a resin solution, an O/W type emulsion is formed and the non-water-soluble organic solvent is removed.

In order to adhere/fuse shell particles onto each surface of core particles, this shell-layer forming process is preferably carried out in succession to the aggregating/fusing processes to obtain core particles. In other words, a shell-particle dispersion solution is added to the dispersion solution of core particles obtained from the aggregating/fusing processes of the binder resin fine particles. At this time, in order to allow the core particles to grow through the adhesion of the shell particles, the process temperature is preferably set to a reaction temperature at which a desired particle size is achieved in the aggregating/fusing processes or a temperature not less than the reaction temperature.

In order to accelerate adhesion of the shell particles to the core particles, the flocculant to be used upon formation of the core particles may be appropriately added thereto.

The blending weight ratio of the core particles and the shell layer, that is, in particular, the blending weight ratio (core: shell) of the total binder resin fine particles (first and second binder resin fine particles) for forming the core particles and the total shell particles forming the shell layer is preferably set in a range from 100:1 to 100:80, more preferably from 100:3 to 100:50.

After the shell particles have been adhered to the core particles in the shell-layer forming process, normally, the aggregating force of the system is completely made to disappear to stop the particle growth, a fusing process is carried out by applying heat, and film-forming and particle-shape-controlling processes are simultaneously carried out on the shell layer. The fusing process is preferably carried out by applying heat to a temperature not less than the glass transition temperature of the shell particles. The fusing process may be carried out while the adhering process progresses.

(Toner Particles)

As described above, in the present invention, since the toner particles each of which has a shell layer formed on the surface of a core particle are dispersed in an aqueous medium, the toner particles are normally subjected to post-treatment processes, such as filtering and washing processes and a drying process.

In the filtering and washing processes, the filtering process in which toner particles are filtered and separated from the toner particle dispersion solution and the washing process in which the surfactant, flocculant and the like are removed from the toner particles separated by filtration are carried. Here, with respect to the filtering method, a centrifugal separation method, a reduced-pressure filtering method using a nutshe and the like and a filtering method using a filter press and the like are proposed; however, the present invention is not intended to be limited by these methods.

The drying process carries out a drying treatment on the toner particles that have been washed. In the drying process, a drying apparatus such as a spray dryer, a vacuum freeze drying machine and a vacuum drying machine is usable, and a stationary rack dryer, a moving rack dryer, a fluid bed dryer, a rotary dryer and a stirring dryer are preferably used. The moisture content of the toner particles after drying treatment is preferably not more than 5%, more preferably not more 2%, by weight. When the toner particles after drying treatment are aggregated together by a weak inter-particle attraction, the aggregated matter may be subjected to a crushing treatment. With respect to the crushing treatment apparatus, a mechanical crushing device, such as a jet mill and a Henschel mixer, is usable.

As described earlier, the toner particles may contain other toner components such as a wax, a charge-controlling agent and magnetic powder. In particular, when the toner of the present invention is used in a full-color image-forming apparatus as a full-color toner, and when the toner of the present invention is used in an image-forming apparatus having a fixing device in which the amount of releasing oil to be applied to fixing members such as rollers is reduced (in particular, oil-less fixing device), the toner particles preferably contain a wax.

When the other toner components are contained in the toner particles, the contained state is not particularly limited, and those components may be added through the respective processes described earlier. In other words, with respect to the contained state of the other toner components in the toner particles, those components may be contained in the core particles, or may be contained in the shell particles.

With respect to the contained state or mode in the core particles, specifically, the following modes are proposed:

(i) a mode in which upon forming core particles, the other toner components are aggregated/fused together with at least the first binder resin fine particles, second binder resin fine particles and colorant fine particles; and (ii) a mode in which the other toner components are contained in the first binder resin fine particles and/or the second binder resin fine particles.

With respect to the contained mode in the shell particles, specifically the following mode is proposed:

(iii) a mode in which, in the case when the shell layer has a multiple layer structure having two or more layers, the other toner components are contained in the shell-layer forming binder resin fine particles except for those contained in the outermost layer.

In particular, a wax is contained in the toner particles in one or more modes selected from the above-mentioned modes (i) to (iii), and is preferably contained at least in mode (i) or mode (ii), more preferably in mode (i) or a composite mode of mode (ii) and mode (iii).

With respect to the wax, known waxes conventionally used in the field of electrostatic latent image developing toners may be used, and examples thereof include: polyolefin-based waxes such as polyethylene wax and polypropylene wax; natural waxes such as carnauba wax and rice wax; and montan wax, Fischer-Tropsch wax, and paraffin-based waxes. In the case when a polyester-based resin is used as the binder resin, an oxidation-type wax is preferably used from the viewpoint of improving the dispersing property.

With respect to the amount of the wax added, the content thereof is preferably set from 0.5 to 12 parts by weight, more preferably from 1 to 10 parts by weight, with respect to 100 parts by weight of the binder resin in the toner particles. In the case when two or more kinds of waxes are contained, the total amount of these is preferably set in the above-mentioned range.

With respect to the charge-controlling agent, known charge-controlling agents conventionally added so as to control a charging property in the field of electrostatic latent image developing toners may be used. Examples thereof include metal-containing dyes such as a fluorine-based surfactant, a salicylic acid metal complex and an azo-based metal compound, a polymeric acid such as a copolymer containing maleic acid as its monomer component, quaternary ammonium salts, azine-based dyes such as Nigrosine, and carbon black. With respect to the amount of the charge-controlling agent added, the content thereof is preferably set from 0.01 to 5 parts by weight, more preferably from 0.05 to 3 parts by weight, with respect to 100 parts by weight of the binder resin in the toner particles.

(Toner)

The toner of the present invention is formed by externally adding an external additive to the above-mentioned toner particles. With respect to the external additive, known inorganic fine particles that have been used as a fluidity-adjusting agent in the field of electrostatic latent image developing toners can be used, and examples of the inorganic fine particles include various carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam, various nitrides such as boron nitride, titanium nitride and zirconium nitride, bromides such as zirconium bromide, various oxides, such as titanium oxide (titania), calcium oxide, magnesium oxide, zinc oxide, copper oxide, aluminum oxide, silica and colloidal silica, various titanic acid compounds, such as calcium titanate, magnesium titanate and strontium titanate, sulfides such as molybdenum disulfide, various fluorides such as magnesium fluoride and carbon fluoride, various metal soaps, such as aluminum stearate, calcium stearate, zinc stearate and magnesium stearate, and various nonmagnetic inorganic fine particles such as talc and bentonite. These materials may be used alone or in combination.

In particular, in the case of the application of inorganic fine particles such as silica, titanium oxide, alumina and zinc oxide, it is preferable to preliminarily carry out a surface treatment by a known method using a conventionally used hydrophobizing agent, such as a silane coupling agent, a titanate-based coupling agent, silicone oil and silicone varnish, or using a treatment agent, such as a fluorine-based silane coupling agent or fluorine-based silicone oil, a coupling agent having an amino group and a quaternary aluminum salt group, and a modified silicone oil.

The average primary fine particle size of the inorganic fine particles used as the external additive is set in a range from 5 to 100 nm, preferably from 10 to 50 nm, more preferably from 20 to 40 nm.

In the present invention, "inorganic fine particles that are outside of the above-mentioned particle-size range" and "organic fine particles" may be further externally added to the toner particles.

With respect to the organic fine particles, so as to serve as a cleaning-assist agent and the like, various kinds of organic fine particles, such as styrene-based fine particles, (meth) acrylic-based fine particles, benzoguanamine, melamine, Teflon (trademark), silicon, polyethylene and polypropylene, which have been granulated by using a wet-type polymerization method, such as an emulsion polymerization method, a soap-free emulsion polymerization method and a nonaqueous dispersion polymerization method, or a gaseous phase method, may be used.

The toner of the present invention may be used as a full-color toner to be used in a full-color image-forming apparatus or may be used as a monochrome toner to be used in a monochrome-image forming apparatus.

The toner of the present invention may be applied to an image-forming apparatus having any type of fixing devices; however, it is preferably applied to an image-forming apparatus having a fixing device in which the amount of releasing oil to be applied to fixing members such as rollers is reduced, that is, a fixing device in which the amount of coat of the releasing oil is not more than 4 mg/m$^2$, in particular, a fixing device in which no releasing oil is applied (oil-less fixing device). Even when used for such an image-forming apparatus, the toner of the present invention effectively achieves a superior low-temperature fixing property while maintaining a superior heat-resistant storing property, mechanical strength and a charge environmental stability.

The following description will discuss the present invention in detail by means of examples.

EXAMPLES (Preparation of Wax Dispersion Solution (1))

Distilled water (680 parts), carnauba wax (made by Cerarica Noda Co., Ltd.) (180 parts) and sodium dodecylbenzene sulfonate (Neogen SC: made by Daiichi Kogyo Seiyaku Co., Ltd.) (17 parts) were mixed and subjected to a high-pressure shearing process to be emulsion-dispersed so that a wax fine particle dispersion solution was obtained. The particle size of the wax fine particles was measured by using an electrophoretic light scattering spectrophotometer ELS-800 (made by Otsuka Electronics Co., Ltd.), and the average particle size was 110 nm.

(Preparation of Wax Dispersion Solution (2))

Distilled water (680 parts), pentaerythritol ester (Unistar H476, made by NOF Corporation.) (180 parts) and sodium dodecylbenzene sulfonate (Neogen SC: made by Daiichi Kogyo Seiyaku Co., Ltd.) (17 parts) were mixed and subjected to a high-pressure shearing process to be emulsion-dispersed so that a wax fine particle dispersion solution was obtained. The particle size of the wax fine particles was measured by using an electrophoretic light scattering spectrophotometer ELS-800 (made by Otsuka Electronics Co., Ltd.), and the average particle size was 130 nm.

(Colorant Fine Particle Dispersion Solution (1))

Sodium dodecylbenzene sulfonate (Neogen SC: made by Daiichi Kogyo Seiyaku Co., Ltd.) (10 parts) was dissolved in 180 parts of distilled water, and to this was added and dispersed 25 parts of carbon black (Regal 330R: Cabot Corporation.) serving as colorant fine particles to prepare a colorant fine particle dispersion solution (1). The particle size of the dispersed carbon black was measured by using an electrophoretic light scattering spectrophotometer ELS-800 (made by Otsuka Electronics Co., Ltd.), and the average particle size was 106 nm.

(Colorant Fine Particle Dispersion Solution (2))

Sodium dodecylbenzene sulfonate (Neogen SC: made by Daiichi Kogyo Seiyaku Co., Ltd.) (10 parts) was dissolved in 180 parts of distilled water, and to this was added and dispersed 25 parts of a cyan pigment (Copper phthalocyanine B15:3, made by Dainichiseika Color & Chemicals Mfg. Co., Ltd.) serving as colorant fine particles to prepare a colorant fine particle dispersion solution (2). The particle size of the dispersed carbon black was measured by using an electrophoretic light scattering spectrophotometer ELS-800 (made by Otsuka Electronics Co., Ltd.), and the average particle size was 110 nm.

(Preparation of Polymer Primary Fine Particle Dispersion Solution (1))

To a reactor equipped with a stirring device, a cooling pipe and a temperature sensor was charged 450 parts of distilled water and 0.56 parts of sodium dodecyl sulfate, and after having been heated to 80° C. while being stirred under a nitrogen gas flow, to this was added 120 parts of an aqueous solution of 1 wt % potassium persulfate. Next, to this was added a monomer mixed solution 1 having the following composition in 1.5 hours, and then further held for 2 hours so as to complete the polymerization. After completion of the polymerization reaction, the contents were cooled to room temperature to obtain a milky-colored polymerization primary fine particle dispersion solution. The weight-average molecular weight of the polymer was 11,000, Tg was 34° C., Tm was 82° C. and the average particle size, measured by an electrophoretic light scattering spectrophotometer (ELS-800; made by Otsuka Electronics Co., Ltd.), was 120 nm.

<Monomer Mixed Solution 1>

| | |
|---|---|
| Styrene | 99 parts |
| Butyl acrylate | 52 parts |
| Methacrylic acid | 14 parts |
| n-octyl mercaptan | 6 parts |

(Preparation of Polymer Primary Fine Particle Dispersion Solution (2))

To a reactor equipped with a stirring device, a cooling pipe and a temperature sensor was charged 450 parts of distilled water and 0.56 parts of sodium dodecyl sulfate, and after having been heated to 80° C. while being stirred under a nitrogen gas flow, to this was added 120 parts of an aqueous solution of 1 wt % potassium persulfate. Next, to this was added a monomer mixed solution 2 having the following composition in 1.5 hours, and then further held for 2 hours so as to complete the polymerization. After completion of the polymerization reaction, the contents were cooled to room temperature to obtain a milky-colored polymerization primary fine particle dispersion solution. The weight-average molecular weight of the polymer was 62,000, Tg was 65° C., Tm was 130° C. and the average particle size, measured by an electrophoretic light scattering spectrophotometer (ELS-800; made by Otsuka Electronics Co., Ltd.), was 120 nm.

<Monomer Mixed Solution 2>

| | |
|---|---|
| Styrene | 125 parts |
| Butyl acrylate | 40 parts |
| Methacrylic acid | 2.5 parts |
| n-octyl mercaptan | 3 parts |

(Preparation of Polymer Primary Fine Particle Dispersion Solution (3))

To a reactor equipped with a stirring device, a cooling pipe and a temperature sensor was charged 45 parts of a wax dispersion solution (2) 450 parts of distilled water and 0.56 parts of sodium dodecyl sulfate, and after having been heated to 80° C. while being stirred under a nitrogen gas flow, to this was added 120 parts of an aqueous solution of 1 wt % potassium persulfate. Next, to this was added a monomer mixed solution 3 having the following composition in 1.5 hours, and then further held for 2 hours so as to complete the polymerization. After completion of the polymerization reaction, the contents were cooled to room temperature to obtain a milky-colored polymerization primary fine particle dispersion solution. The weight-average molecular weight of the polymer was 48,000, Tg was 55° C., Tm was 110° C. and the average particle size, measured by an electrophoretic light scattering spectrophotometer (ELS-800; made by Otsuka Electronics Co., Ltd.), was 130 nm.

<Monomer Mixed Solution 3>

| | |
|---|---|
| Styrene | 120 parts |
| Butyl acrylate | 38 parts |
| Methacrylic acid | 13 parts |
| n-octyl mercaptan | 3 parts |

(Preparation of Polymer Primary Fine Particle Dispersion Solution (4))

To a four-neck flask (10 L) equipped with a stirring device, a distilling tower, an inert gas introducing tube and a thermometer were charged 2200 parts by weight of polyoxyethylene (2,2)-2,2-bis(4-hydroxyphenyl) propane, 120 parts by weight of neopentyl glycol, 1100 parts by weight of terephthalic acid and 200 parts by weight of isophthalic acid, and after having been heated to 180° C. under a nitrogen gas flow, to this was added 5 parts by weight of dibutyl tin oxide and heated for 2 hours. Next, this was further heated to 230° C. so that the reaction progressed until no water was distilled from the distilling tower and an acid value of 4.2 KOH mg/g and a softening point of 85° C. were achieved; thus, a polyester resin A was obtained. Polyester resin A had a glass transition point of 36° C., a number-average molecular weight of 4,200 and a ratio of weight average molecular weight/number average molecular weight of 3.5.

Next, polyester resin A (20 parts), ethyl acetate (70 parts), MEK (30 parts) were put into a beaker, and stirred by a TK homomixer (made by Tokushu Kika Kogyo Co., Ltd.) at 12000 rpm to be uniformly dissolved and dispersed so that a polyester resin solution was prepared.

Further, in a three-neck flask equipped with a thermometer and a stirring device, 0.5% by weight of a dispersant (sodium dodecylbenzene sulfonate) and 0.5% by weight of polyvinyl alcohol were dissolved in 450 parts of ion exchanged water so that an aqueous medium was prepared.

The above-mentioned resin solution was suspended in the aqueous medium by using a TK homomixer to prepare an O/W type emulsion. At this time, the number of revolution of the TK homomixer was set at 10000 rpm and the stirring process continued for 30 minutes. Thereafter, this was heated while being stirred at the number of revolution of 200 rpm to remove the mixed solvent so that a polymer primary fine particle dispersant (4) having a volume average particle size of 150 nm was obtained.

(Preparation of Polymer Primary Fine Particle Dispersion Solution (5))

To a reactor equipped with a stirring device, a cooling pipe and a temperature sensor was charged 450 parts of distilled water and 0.56 parts of sodium dodecyl sulfate, and after having been heated to 80° C. while being stirred under a nitrogen gas flow, to this was added 120 parts of an aqueous solution of 1 wt % potassium persulfate. Next, to this was added a monomer mixed solution 4 having the following composition in 1.5 hours, and then further held for 2 hours so as to complete the polymerization. After completion of the polymerization reaction, the contents were cooled to room temperature to obtain a milky-colored polymerization primary fine particle dispersion solution. The weight-average molecular weight of the polymer was 9,800, Tg was 30° C., Tm was 78° C. and the average particle size, measured by an electrophoretic light scattering spectrophotometer (ELS-800; made by Otsuka Electronics Co., Ltd.), was 110 nm.

<Monomer Mixed Solution 4>

| | |
|---|---|
| Styrene | 95 parts |
| Butyl acrylate | 58 parts |
| Methacrylic acid | 12 parts |
| n-octyl mercaptan | 8 parts |

Example 1

To a reactor equipped with a stirring device, a cooling pipe and a temperature sensor were charged 140 parts of a polymer primary fine particle dispersion solution (1), 100 parts of a polymer primary fine particle dispersion solution (2), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred and maintained for 0.5 hours, and then further heated to 88° C. and further maintained for 0.5 hours. At this time, the average particle size of the toner in the mixed dispersion solution was 4.2 μm. Next, after the system had been cooled to 75° C., to this was added 20 parts of a polymer primary fine particle dispersion solution (3) and heated to 83° C. and maintained for 1.5 hours, and to this was then added 30 parts of the polymer primary fine particle dispersion solution (2) and heated to 85° C. and maintained for 1.5 hours; thereafter, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 1 having a volume average particle size of 4.6 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Example 2

The same processes as those of example 1 were carried out except that in place of the colorant fine particle dispersion solution (1), the colorant fine particle dispersion solution (2) was used to prepare toner particles 2 having a volume-average particle size of 4.6 μm. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Example 3

The same processes as those of example 1 were carried out except that in place of the wax dispersion solution (1), a wax dispersion solution (2) was used to prepare toner particles 3 having a volume-average particle size of 4.4 μm. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Example 4

To a reactor equipped with a stirring device, a cooling pipe and a temperature sensor were charged 140 parts of a polymer primary fine particle dispersion solution (1), 100 parts of a polymer primary fine particle dispersion solution (3), 24 parts of a colorant fine particle dispersion solution (1) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 85° C. while being stirred and maintained for 1.5 hours. At this time, the average particle size of the toner in the mixed dispersion solution was 4.1 μm. Next, after the system had been cooled to 75° C., to this was added 20 parts of a polymer primary fine particle dispersion solution (3) and heated to 83° C. and maintained for 1.5 hours, and to this was then added 30 parts of the polymer primary fine particle dispersion solution (2) and heated to 85° C. and maintained for 1.5 hours; thereafter, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 4 having a volume average particle size of 4.3 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Example 5

The same processes as those of example 1 were carried out except that in place of the polymer primary fine particle dispersion solution (1), a polymer primary fine particle dispersion solution (4) was used to prepare toner particles 5 having a volume-average particle size of 4.6 μm. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Example 6

To a reactor equipped with a stirring device, a cooling pipe and a temperature sensor were charged 70 parts of a polymer primary fine particle dispersion solution (1), 100 parts of a polymer primary fine particle dispersion solution (2), 70 parts of a polymer primary fine particle dispersion solution (4), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred and maintained for 0.5 hours, and then further heated to 88° C. and maintained for 0.5 hours. At this time, the average particle size of the toner in the mixed dispersion solution was 4.2 μm. Next, after the system had been cooled to 75° C., to this was added 48 parts of a polymer primary fine particle dispersion solution (3) and heated to 83° C. and maintained for 1.5 hours, and to this was then added 60 parts of the polymer primary fine particle dispersion solution (2) and heated to 85° C. and maintained for 1.5 hours; thereafter, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 6 having a volume average particle size of 4.5 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Example 7

To a reactor equipped with a stirring device, a cooling pipe and a temperature sensor were charged 140 parts of a polymer primary fine particle dispersion solution (1), 100 parts of a polymer primary fine particle dispersion solution (2), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred and maintained for 0.5 hours, and then further heated to 88° C. and maintained for 0.5 hours. At this time, the average particle size of the toner in the mixed dispersion solution was 4.3 μm. Next, after the system had been cooled to 75° C., to this was added 50 parts of the polymer primary fine particle dispersion solution (2) and heated to 85° C. and maintained for 1.5 hours; thereafter, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 7 having a volume average particle size of 4.7 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Comparative Example 1

To a reactor equipped with a stirring device, a cooling pipe and a temperature sensor were charged 288 parts of a polymer primary fine particle dispersion solution (2), 13.6 parts of a wax dispersion solution (1), 24 parts of a colorant fine particle dispersion solution (1) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 70° C. while being stirred and maintained for 1.5 hours. At this time, the average particle size of the toner in the mixed dispersion solution was 4.5 μm. Next, after having added 120 parts of 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 8 having a volume average particle size of 4.4 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain-a toner.

Comparative Example 2

To a reactor equipped with a stirring device, a cooling pipe and a temperature sensor were charged 240 parts of a polymer primary fine particle dispersion solution (2), 13.6 parts of a wax dispersion solution (1), 24 parts of a colorant fine particle dispersion solution (2) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 85° C. while being stirred and maintained for 1.5 hours. At this time, the average particle size of the toner in the mixed dispersion solution was 4.2 μm. Next, after the system had been cooled to 75° C., to this was added 50 parts of the polymer primary fine particle dispersion solution (2) and heated to 83° C. and maintained for 0.5 hours; thereafter, after having added 120 parts of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 9 having a volume average particle size of 4.3 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Comparative Example 3

To a reactor equipped with a stirring device, a cooling pipe and a temperature sensor were charged 240 parts of a polymer primary fine particle dispersion solution (1), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred, and maintained for 1.5 hours. At this time, the average particle size of the toner in the mixed dispersion solution was 4.6 μm. Next, after the system had been cooled to 75° C., to this was added 50 parts of the polymer primary fine particle dispersion solution (2) and heated to 83° C. and maintained for 0.5 hours; thereafter, after having added 120 parts of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 10 having a volume average particle size of 4.7 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Comparative Example 4

To a reactor equipped with a stirring device, a cooling pipe and a temperature sensor were charged 140 parts of a polymer primary fine particle dispersion solution (1), 100 parts of a polymer primary fine particle dispersion solution (5), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred, and maintained for 0.5 hours, and then further heated to 88° C., and maintained for 0.5 hours. At this time, the average particle size of the toner in the mixed dispersion solution was 4.2 μm. Next, after the system had been cooled to 75° C., to this was added 50 parts of the polymer primary fine particle dispersion solution (2) and heated to 85° C. and maintained for 1.5 hours; thereafter, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 11 having a volume average particle size of 4.5 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Comparative Example 5

To a reactor equipped with a stirring device, a cooling pipe and a temperature sensor were charged 140 parts of a polymer primary fine particle dispersion solution (2), 100 parts of a polymer primary fine particle dispersion solution (3), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred, and maintained for 0.5 hours, and then further heated to 88° C., and maintained for 0.5 hours. At this time, the average particle size of the toner in the mixed dispersion solution was 4.3 μm. Next, after the system had been cooled to 75° C., to this was added 50 parts of the polymer primary fine particle dispersion solution (2) and heated to 85° C. and maintained for 1.5 hours; thereafter, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 12 having a volume average particle size of 4.6 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Comparative Example 6

To a reactor equipped with a stirring device, a cooling pipe and a temperature sensor were charged 140 parts of a polymer primary fine particle dispersion solution (1), 100 parts of a polymer primary fine particle dispersion solution (5), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred, and maintained for 0.5 hours, and then further heated to 88° C., and maintained for 0.5 hours. At this time, the average particle size of the toner in the mixed dispersion solution was 4.5 μm. Next, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 13 having a volume average particle size of 4.4 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

Comparative Example 7

To a reactor equipped with a stirring device, a cooling pipe and a temperature sensor were charged 140 parts of a polymer primary fine particle dispersion solution (1), 100 parts of a polymer primary fine particle dispersion solution (2), 13.6 parts of a wax dispersion solution (1), 24 parts of a colorant fine particle dispersion solution (1), 5 parts of an anionic surfactant (Neogen SC: made by Daiichi Kogyo Seiyaku Co., Ltd.) and 240 parts of distilled water, and to this was added a 2N sodium hydroxide aqueous solution while being stirred so that the pH of the mixed dispersion solution was adjusted to 10.0. Next, after 40 parts of a 50 wt % magnesium chloride aqueous solution had been added thereto, this was heated to 80° C. while being stirred, and maintained for 0.5 hours, and then further heated to 88° C., and maintained for 0.5 hours. At this time, the average particle size of the toner in the mixed dispersion solution was 4.4 μm. Next, after having added 120 g of a 20 wt % sodium chloride aqueous solution thereto, this was heated to 92° C., and maintained for 1 hour. Then, the contents were cooled to room temperature, and the resulting product was subjected to rinsing processes, such as filtration of the solution and re-suspension treatment of the resulting solid components into distilled water, repeatedly several times, and then dried so that toner particles 14 having a volume average particle size of 4.3 μm were obtained. To 100 parts by weight of these toner particles were added 0.5 parts by weight of hydrophobic silica (H-2000: made by Clariant Corp.), 1.0 part by weight of titanium oxide (STT30A: made by Titan Kogyo K.K.) and 1.0 part by weight of strontium titanate (average particle size: 0.2 μm), and after having been mixed by a Henschel mixer (at a peripheral speed of 40 m/sec for 60 seconds), these were filtered through a sieve of 90 μm mesh to obtain a toner.

(Production of Binder-Type Carrier)

In order to evaluate each of the toners obtained in the above-mentioned examples and comparative example as a two-component developer, a binder-type carrier was prepared. A polyester-based resin (NE-1110: made by Kao Corporation) (100 parts by weight), magnetic particles (magnetite; EPT-1000: made by Toda Kogyo Co., Ltd.) (700 parts by weight) and carbon black (Mogul L: made by Cabot Corporation) (2 parts by weight) were sufficiently mixed by a Henschel mixer, and melt-kneaded by a twin-screw kneader that was set at 180° C. in its cylinder portion and at 170° C. in its cylinder head portion. This kneaded matter was cooled, and then coarsely pulverized with a hammer mill and finely pulverized with a jet mill; thus, the resulting particles were classified to obtain a binder-type carrier having a volume-average particle size of 40 μm.

(Toner Characteristic Evaluation Method)

Heat Resistant Storing Property

Toner (10 g) was left at a high temperature of 50° C. for 24 hours, and the resulting toner was visually observed, and evaluated.

○: There were no aggregated toner clumps;

Δ: There were less than 10 aggregated toner clumps; and x: There were not less than 10 aggregated toner clumps.

With respect to the following evaluations, a developer, which was obtained by mixing each of the toners and the carrier so as to have a toner concentration of 6% by weight, was used.

Fixing Property

The fixing property was totally evaluated based upon evaluation results of the anti-peeling property and anti-offset property.

○: The results of all the items were "◎" or "○";

Δ: In addition to "◎" or "○", "Δ" was contained; and x: At least one "x" was contained.

<Anti-Peeling Property>

Solid images of 1.5 cm×1.5 cm (amount of adhesion: 2.0 mg/cm$^2$) were obtained through a digital copying machine (DIALTA Di350; made by Minolta Co., Ltd.) equipped with an oil-less fixing device, with the fixing temperature being changed by a unit of 2° C. within a range of 80 to 130° C., and each image was folded into two in the middle so that the anti-peeling property of the image was visually observed and evaluated. A temperature range between a fixing temperature at which peeling slightly occurred in the image and a lower limit fixing temperature at which no peeling occurred was defined as a fixing lower limit temperature.

◎: The fixing lower limit temperature was less than 102° C.;

○: The fixing lower limit temperature was in a range from not less than 102° C. to less than 106° C.;

Δ: The fixing lower limit temperature was in a range from not less than 106° C. to less than 112° C.; and x: The fixing lower limit temperature was not less than 112° C.

<Anti-Offset Property>

Half-tone images were obtained through a digital copying machine (DIALTA Di350; made by Minolta Co., Ltd.) with the fixing system speed being set to ½, while the fixing temperature was changed by a unit of 5° C. within a range of 90 to 150° C., and each image was visually observed for any offset; thus, a lower limit temperature at which a high-temperature offset occurred was evaluated as an offset temperature.

◎: The offset temperature was not less than 128° C.;

○: The offset temperature was in a range from not less than 120° C. to less than 128° C.;

Δ: The offset temperature was in a range from not less than 115° C. to less than 120° C.; and x: The offset temperature was not less than 115° C.

Charge Environmental Stability (Environment Resistant Stability)

The charge environmental stability was evaluated based upon a difference between a quantity of charge in a developer that was stored under a low-temperature/low-humidity environment (10° C., 15%) for 24 hours and a quantity of charge in a developer that was stored under a high-temperature/high-humidity environment (30° C., 85%) for 24 hours.

◎: The absolute value of a difference was less than 4 μC/g;

○: The absolute value of a difference was in a range from not less than 4 μC/g to less than 6 μC/g;

Δ: The absolute value of a difference was in a range from not less than 6 μC/g to less than 8 μC/g;

x: The absolute value of a difference was in a range from not less than 8 μC/g to less than 10 μC/g; and xx: The absolute value of a difference was not less than 10 μC/g.

Stress Resistant Property

The stress resistant property was evaluated based upon the presence or absence of squashed or worn toner particles adhering to the surface of the photosensitive member in a thin-film state due to continuous use of toner.

○: No adhesion of toner particles was visually observed;

x: Adhesion of toner particles was visually observed.

TABLE 1

| | Particle size (μm)(D50) | Evaluation results: Heat resistance storing property | Environment resistant stability | Fixing property | Stress resistant property |
|---|---|---|---|---|---|
| Example 1 | 4.6 | ○ | ◎ | ○ | ○ |
| Example 2 | 4.6 | ○ | ◎ | ○ | ○ |
| Example 3 | 4.4 | ○ | ◎ | ○ | ○ |

TABLE 1-continued

| | Particle size (μm)(D50) | Evaluation results: Heat resistance storing property | Environment resistant stability | Fixing property | Stress resistant property |
|---|---|---|---|---|---|
| Example 4 | 4.3 | ○ | ◎ | ○ | ○ |
| Example 5 | 4.6 | ○ | ◎ | ○ | ○ |
| Example 6 | 4.5 | ○ | ◎ | ○ | ○ |
| Example 7 | 4.7 | ○ | ◎ | ○ | ○ |
| Comparative Example 1 | 4.4 | X | XX | X | X |
| Comparative Example 2 | 4.3 | ○ | ○ | X | ○ |
| Comparative Example 3 | 4.7 | ○ | ○ | X | X |
| Comparative Example 4 | 4.5 | ○ | ○ | X | X |
| Comparative Example 5 | 4.6 | ○ | ○ | X | ○ |
| Comparative Example 6 | 4.4 | X | XX | X | X |
| Comparative Example 7 | 4.3 | X | XX | ○ | X |

(Physical Property Measuring Method for Toner and Resin Particles)

When resin fine particles (polymer primary fine particles) contain other toner components such as wax, the physical property values of the corresponding resin are the same as the measured values of resin fine particles that are formed in the same method as the method for forming other resin fine particles except that the other toner components are not contained.

Toner Volume-Average Particle Size

The volume-average particle size (D) was measured by using a Coulter Multisizer II (made by Coulter Counter Inc.) with an aperture tube diameter of 50 μm. In this invention, the volume-average particle diameter expresses a median size in volume particle size distribution.

Degree of Roundness

The degree of roundness is indicated by "Peripheral length of a circle equal to projection area of a particle/Peripheral length of a particle projection image". The average degree of roundness was measured by a flow-type particle image analyzer (FPIA-2000; made by Sysmex Corporation) through an aqueous dispersion system.

Glass Transition Temperature Tg

The glass transition temperature was measured by a differential scanning calorimeter (DSC-200: made by Seiko Instruments Inc.) in which: by using alumina put in an aluminum pan as the reference, 10 mg of a sample was precisely weighed and put into an aluminum pan, and after having been heated from room temperature to 200° C. at a temperature-rise rate of 30° C./min, this was cooled and measured in a temperature range from 20 to 120° C. at a temperature-rise rate of 10° C./min; thus the shoulder value of the main heat-absorption peak in the range from 30 to 90° C. in the temperature-raising process was defined as the glass transition point.

Softening Point Tm

The softening point was measured by a Flow Tester (CFT-500; made by Shimadzu Corporation). A sample (1.0 g) to be measured was weighed and subjected to measurements by using a die having 1.0 mm in diameter×1.0 mm in length under the conditions of a temperature-rise rate of 3.0° C./min, pre-heating time of 180 seconds, a load of 30 kg and a measuring temperature range from 60 to 180° C., and the temperature at the time of ½ flow-out of the sample was defined as a softening point.

Molecular Weight

With respect to the molecular weight, measurements were carried out by using a gel permeation chromatography (807-IT Type: Nippon Bunko Kogyo K.K.) in which: 1 kg/cm$^2$ of tetrahydrofuran was allowed to flow as a carrier solvent while the column was maintained at 40° C., and 30 mg of a sample to be measured was dissolved in 20 ml of tetrahydrofuran, and then, 0.5 mg of this solution was introduced into the device together with the carrier solvent; thus the molecular weight was obtained based upon polystyrene conversion.

What is claimed is:

1. An electrostatic latent image developing toner comprising:

toner particles each of which has a shell layer on the surface of a core particle comprising at least a first binder resin having a softening point of less than 100° C., a second binder resin having a softening point of not less than 100° C., was and a colorant, wherein the core particle is formed by allowing at least first binder resin particles, second binder resin particles and colorant particles to aggregate/fusion-adhere to one another, and a process in which the shell layer is formed by allowing shell-layer-forming binder resin particles to adhere/fuse onto the surface of the core particle is carried out;

wherein the shell layer has a multiple layer structure with two or more layers and the constituent resin of the outermost layer has a glass transition point of 55-75° C.

2. An electrostatic latent image developing toner comprising:

toner particles each of which has a shell layer on the surface of a core particle comprising at least a first binder resin having a softening point of less than 100° C., a second binder resin having a softening point of not less than 100° C., wax and a colorant, wherein the core particle is formed by allowing at least first binder resin particles, second binder resin particles and colorant particles to aggregate/fusion-adhere to one another, and a process in which the shell layer is formed by allowing shell-layer-forming binder resin particles to adhere/fuse onto the surface of the core particle is carried out;

wherein the shell layer has a multiple layer structure with two or more layers, and the constituent resin of the outermost layer has a glass transition point of 55-75° C. and a softening point of 100-160° C.

3. The toner of claim 2, wherein each of the first binder resin, the second binder resin and the shell-layer-forming binder resin is independently made from at least one kind of resins selected from the group consisting of a vinyl-based resin, a polyurethane resin, an epoxy resin and a polyester resin.

4. The toner of claim 2, wherein the toner particles are allowed to contain a wax in not less than one mode selected from the following modes:

(i) a mode in which upon forming core particles, the wax is aggregated/fusion-adhered thereto together with at least the first binder resin fine particles, the second binder resin fine particles and the colorant fine particles;

(ii) a mode in which the wax is contained in the first binder resin fine particles and/or the second binder resin fine particles; and (iii) a mode in which, when the shell layer has a multiple layer structure with two or more layers, the wax is contained in shell-layer-forming binder resin fine particles other than those in the outermost layer.

5. The toner of claim 2, wherein the first binder resin has the softening point of 60-95° C.

6. The toner of claim 5, wherein the second binder resin has the softening point of 100-150° C.

7. The toner of claim 5, wherein the first binder resin has the softening point of 75-90° C.

8. The toner of claim 5, wherein the second binder resin has the softening point of 105-130° C.

9. The toner of claim 2, wherein the second binder resin has the softening point of 100-150° C.

10. The toner of claim 7, wherein the second binder resin has the softening point of 105-135° C.

11. The toner of claim 2, wherein the constituent resin has the glass transition point of 60-70° C. and a softening point of 110-140° C.

12. The toner of claim 3, wherein the first binder resin has the softening point of 60-95° C. and the second binder resin has the softening point of 100-150° C.

13. The toner of claim 2, wherein the first binder resin has the softening point of 60-95° C. and the second binder resin has the softening point of 100-150° C.

14. The toner of claim 13, wherein the first binder resin has a glass transition point of 23-43° C. and the second binder resin has a glass transition point of 45-80° C.

15. The toner of claim 14, wherein the first binder resin has the glass transition point of 25-40° C. and the second binder resin has the glass transition point of 50-70° C.

16. The toner of claim 2, wherein the first binder resin has a glass transition point of 23-43° C. and the second binder resin has a glass transition point of 45-80° C.

* * * * *

UNITED STATES PATENT AND TRADEMARK OFFICE

CERTIFICATE OF CORRECTION

PATENT NO. : 7,465,526 B2
APPLICATION NO. : 11/038521
DATED : December 16, 2008
INVENTOR(S) : Yasumitsu Fujino et al.

It is certified that error appears in the above-identified patent and that said Letters Patent is hereby corrected as shown below:

Claim 1, Column 25, Line 19: change “was” to --wax--.

Signed and Sealed this

Seventh Day of April, 2009

JOHN DOLL
*Acting Director of the United States Patent and Trademark Office*